US006701575B2

(12) United States Patent
Padiak et al.

(10) Patent No.: US 6,701,575 B2
(45) Date of Patent: Mar. 9, 2004

(54) HINGE MOUNTING ASSEMBLY FOR A STORAGE RACK

(75) Inventors: Scott Padiak, Winnetka, IL (US); Thomas M. Conway, Chicago, IL (US); Paul C. Evans, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 127 days.

(21) Appl. No.: 10/044,697

(22) Filed: Jan. 11, 2002

(65) Prior Publication Data

US 2003/0131445 A1 Jul. 17, 2003

(51) Int. Cl.[7] ..... E05F 1/02
(52) U.S. Cl. ..... 16/309; 16/221
(58) Field of Search ..... 16/309, 312, 316, 16/318, DIG. 27, 221; 49/381, 382, 397–399, 236

(56) References Cited

U.S. PATENT DOCUMENTS 785,143 A * 3/1905 Winter ..... 16/318
918,731 A * 4/1909 Brooks ..... 16/351
2,281,158 A * 4/1942 Keene ..... 16/362
3,858,274 A * 1/1975 Burton et al. ..... 16/312
4,030,161 A * 6/1977 Loikitz ..... 16/284
RE30,717 E * 8/1981 Dargene ..... 16/264
4,389,748 A * 6/1983 Grossman ..... 16/278
5,455,987 A * 10/1995 Svehaug ..... 16/267
6,125,510 A * 10/2000 Domenig ..... 16/382
6,314,616 B1 * 11/2001 King ..... 16/382
6,484,363 B1 * 11/2002 Chung ..... 16/242
6,564,428 B2 * 5/2003 Richard et al. ..... 16/366

* cited by examiner

*Primary Examiner*—Anthony Knight
*Assistant Examiner*—André L. Jackson
(74) *Attorney, Agent, or Firm*—Welsh & Katz, Ltd.

(57) ABSTRACT

A hinge mounting assembly for an associated door panel is used for mounting to a panel to a storage rack. The rack generally includes at least one post having a front face and a side face. The front face has slots therein and the door panel generally has at least one bore defined therein. The hinge mounting assembly has a post plate and a door clamping member. The post plate has a hinge portion with a first end and a second end. The first end has bearing surfaces and an intermediate helical bearing surface. A door clamping member is pivotally mounted to the post plate. The door clamping member has a hinge post with a bearing surfaces and a helical bearing surface. The helical bearing surfaces enable the hinge mounting assembly to be "self closing" as well as reversibly mounted to the post.

18 Claims, 2 Drawing Sheets

FIG. 1
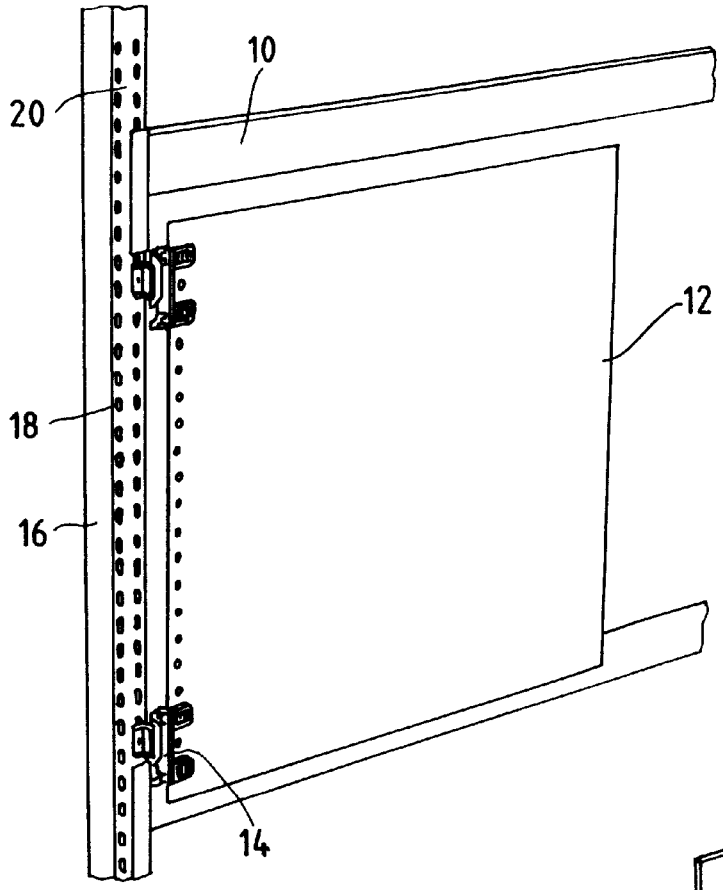
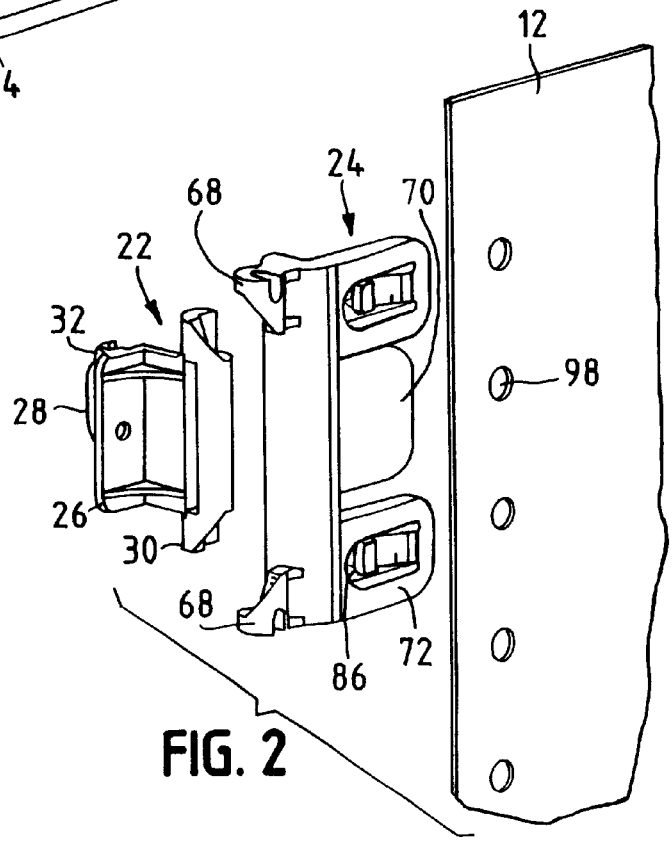
FIG. 2

HINGE MOUNTING ASSEMBLY FOR A STORAGE RACK

BACKGROUND OF THE INVENTION

The present invention pertains to a door mount assembly for mounting a door panel to a storage rack arrangement. More particularly, the invention pertains to a self-closing, reversible hinge mounting assembly for pivotally mounting a door to a storage rack arrangement.

A wide variety of storage systems, such as shelves, racks, and the like are used in both retail and wholesale trades for storing and displaying items for sale. One common type of heavy-duty shelf system that is used, particularly in home improvement centers, and "warehouse-club" types of establishments is commonly referred to as a pallet rack.

Such storage systems typically include vertical risers or posts for supporting one or more shelves. The shelves generally span the area between the vertical posts and are primarily used to store consumer accessible items, or to store merchandise stock. To this end, doors or covers can be mounted in front of these storage shelves in order to deter consumer access or to prevent what might otherwise be an unsightly or unaesthetically appealing storage arrangement of merchandise. Additionally, these doors can be used as a type of signage for displaying product or service advertisements, as well as other useful information.

Known door mount systems suffer from numerous drawbacks. First, such systems are generally installation intensive, requiring numerous parts and thus considerable labor and cost to install. In addition, such systems often include a large number of small parts, such as hinges, nuts, bolts and the like, which can be lost or misplaced. Moreover, many hinge assemblies are limited in that they are not reversible meaning that they can only be mounted to either the right or left posts. This requires the extra feature of "separate" left-only and right-only post hinges.

Further, many of the self-closing types of hinges use springs and the like to return the door to a closed position. This also has its drawbacks or disadvantages in that springs can stretch or break, thus requiring service or replacement. In addition, such spring type hinges may not permit positioning the door in a "held-open" position while retaining a self-closing feature.

Accordingly, there exists a need for a hinge assembly for pivotally mounting doors to a storage rack. It is desirable that such hinge assembly is "self-closing" but permits positioning the door in a "held-open" position when it is fully opened. More desirably, such a hinge assembly can be reversibly installed on either the right post or the left post as desired, enabling the connected door to open outwardly in opposing directions.

SUMMARY OF THE INVENTION

A hinge mounting assembly for an associated door panel is used for mounting to a storage rack. The rack generally includes at least one post having a front face and a side face. The front face has slots therein and the door panel generally has at least one bore defined therein.

The hinge mounting assembly comprises a post plate mountable to the post. The post plate includes a base portion for positioning adjacent to the front face of the post, a post return for positioning adjacent to a side face of the post, and a body. The base portion has at least one post lock extending generally outwardly therefrom and is configured to be inserted into the post slots. The post lock has a lip portion for securely locking the post plate to the post slot. The body has a hinge portion with a first end and a second end. The first end has first and second post bearing surfaces and an intermediate helically extending surface between the first and second post bearing surfaces.

The door clamping member is pivotally mounted to the post plate. The door clamping member has a body, a hinge post, a tongue support and at least one locking tab. The locking tab extends in a generally transverse direction from the body for engagement with a first surface of the panel. The locking tab includes an opening and a finger that extends into the opening and is configured for insertion into the bore in the panel.

The tongue support extends generally outwardly from the body for providing an abutting surface with a second surface of the panel. The tongue support and locking tabs cooperate with one another to provide secure mounting of the door panel. The hinge post has a first clamp bearing surface, a second clamp bearing surface and a helically extending clamp bearing surface between the first and second clamp bearing surfaces. The hinge mount assembly includes a hinge pin pivotally connecting the post plate and the door clamping member.

When the hinge mounting assembly is in an open position, the second clamp bearing surface bears on the first post bearing surface and when in a closed position the second clamp bearing surface bears on the second post bearing surface. When the hinge mount assembly is in an intermediate position between the open and closed positions, the post helical surface and clamp helical surface slide relative to each other such that the hinge assembly tends to move to the closed position.

In a preferred embodiment the base portion has two post locks for insertion into respective post slots. In another embodiment, door clamping member has two locking tabs for engagement with the first surface of the panel. In yet another embodiment, the finger includes a detent portion for insertion into the bore in the panel.

In still another embodiment, the second end of the post plate body includes first post and second post bearing surfaces and an intermediate helically extending surface between the first and second post bearing surfaces. In yet another embodiment, the door clamping member has two hinge posts positioned at respective first and second ends of the door clamping member for engagement with the respective first and second ends of the post plate body so as to enable the hinge mounting assembly to be reversibly pivoted.

These and other features and advantages of the present invention will be apparent from the following detailed description, in conjunction with the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein:

FIG. 1 is a perspective view of a storage shelf system having a door mounted thereto by a reversible hinge mounting assembly embodying the principles of the present invention;

FIG. 2 is an exploded view of the hinge mounting assembly of FIG. 1, illustrating a post plate and door-clamp member;

DETAILED DESCRIPTION OF THE INVENTION

Figure 3A:
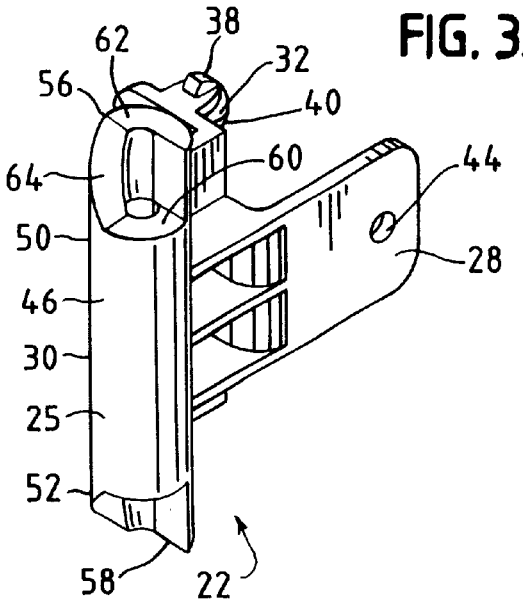
FIG. 3A is a perspective view of the post plate of the hinge assembly of FIG. 1.

While the present invention is susceptible of embodiment in various forms, there is shown in the drawings an embodiment of the present invention that is discussed in greater detail hereafter. It should be understood that the present disclosure is to be considered as an exemplification of the present invention, and is not intended to limit the invention to the specific embodiment illustrated. It should be further understood that the title of this section of this application, namely "Detailed Description of the Invention" relates to a requirement of the United States Patent and Trademark Office, and should not be found to be limiting to the subject matter disclosed herein.

In the present disclosure, the words "a" or "an" are to be taken to include both the singular and the plural. Conversely, any reference to plural items shall, where appropriate, include the singular.

Referring now to the drawings, particularly FIG. 1, there is shown an exemplary storage rack arrangement 10 having a door panel 12 mounted thereto by a reversible hinge assembly 14 embodying the principles of the present invention. The exemplary storage rack 10 includes one or more vertically oriented posts 16 or uprights (one shown), spaced apart from one another. Typically, the posts 16 are in parallel relationship to one another to provide the storage rack arrangement 10 with additional vertical support. In a typical arrangement, each post 16 defines a mounting region and has a plurality of openings or slots 18. The slots 18 are used to secure the hinge assembly 14 to the posts 16. Preferably, the slots 18 are vertically arranged on a first surface or front face 20 of the post 16, as shown. Those skilled in the art will recognize from a study of the following description and the figures that the present hinge assembly, although described with reference to mounting to a vertical post, can be adapted for mounting to a shelf or like horizontal support. For ease of description only, the following makes reference to a vertical mount, but, it is to be understood that other (e.g., horizontal mounts) are within the scope and spirit of the present invention.

The reversible hinge assembly 14 engages the post 16 at slots 18, enabling the assembly 14 to be securely connected to the post 16. The hinge assembly 14 mounts the door panel 12 to the post 16, such that the panel 12 can be pivotally moved into an open or closed position relative to the rack 10.

Referring now to FIG. 2, there is an exploded view of one embodiment of the hinge assembly 14. The hinge assembly 14 includes a mounting plate or post plate 22 configured for secure connection to the post 16 and a door-clamp member 24 for connecting to the door panel 12.

Figure 3B:
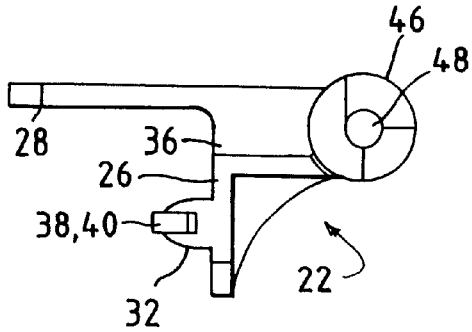
FIG. 3B is a top view of the post plate of the hinge assembly of FIG. 1.

Referring now to FIGS. 3A and 3B, the post plate 22 includes a base portion 26, a post-return 28, a body 30 and at least one, and preferably two mounting or post locks 32, for securing the hinged mounting assembly 14 to the post 16. The base portion 26 and post-return 28 are arranged in a generally perpendicular manner such that when the post plate 22 is mounted to the post 16, the base portion 26 engages the front wall 20 of the post 16 and the post return 28 engages a second face or side wall (not shown) of the post 16. The base portion 20 includes a first surface 36 that lies on or abuts the posts front face 20.

Post locks 32 are hook-like elements that extend outwardly from the first surface 36 to securely connect the base portion 26 to the post 16. The locks 32 include transversely extending upper and lower locking lips 38, 40 respectively. Although the lips 38, 40 are referred to as upper and lower, it will be recognized by those skilled in the art that when used on an opposing post (i.e., left-to-right or right-to-left), the "position" (e.g., upper or lower) will be reversed. The lips 38, 40 permit positioning the first surface 36 on the front wall 20 of the post 16 to insert the locks 32 into the post slots 20. The plate 22 is then urged or forced downward, thereby engaging the lips 38, 40 with an inner wall surface (not shown) of the post 16, locking the plate 22 to the post 16. The base portion 26 can include one or more bores (not shown) for receiving a fastening member (not shown), such as a screw, bolt, or the like to lock the plate to the post 16.

The post return 28 lies on (e.g., abuts) the side wall 34 of the post 16. Like the base 26, the post return 28 can include an opening 44 for receiving a fastening member to secure the plate 22 to the post 16. In a mounted position, the post return 28 is locked to the side wall of the post 16.

The body 30 includes a hinge portion 46 that has a generally cylindrical shape. The hinge 46 includes a central, longitudinal bore 48 that extends lengthwise through the body 36 from an upper or first end 50 to a lower or second end 52. The bore 48 is configured to receive a hinge pin 54, which pivotally connects the post plate 22 to the door-clamp member 24. In the connected arrangement (as will be discussed in more detail below), the clamp member 24 pivots and slides relative to the post plate 22, along the hinge pin 54.

The hinge portion 46 has a first end 56 (illustrated as the upper end) and second end 58 (illustrated as the lower end). The first end 56 of the hinge portion 46 has first and second bearing surfaces 60, 62, and a helically-curved surface 64 extending between the bearing surfaces 60, 62. The intermediate curved surface 64 has a generally helical shape, extending in an inclined, angular manner as it transverses between and connects surfaces 60 and 62. In a preferred embodiment, the hinge portion 46 upper and lower ends 50 and 52 each include a "set" of bearing and helical surfaces 60, 62, 64, (and 60', 62', 64'). As illustrated, each "set" of surfaces 60, 62, 64 and 60', 62', 64' is a mirror image of the other, enabling the hinge assembly 14 to be reversibly mounted.

Figure 4A:
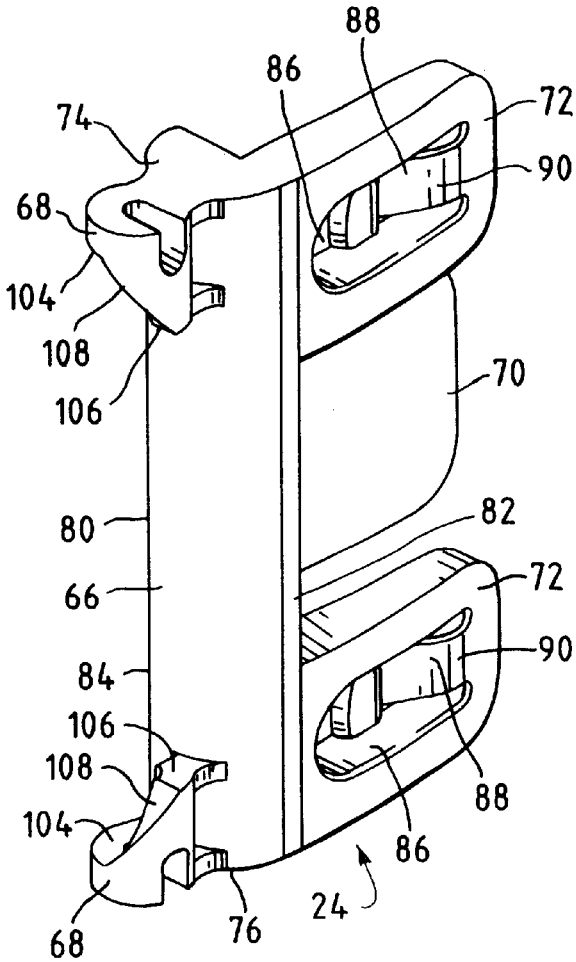
FIG. 4A is perspective view of the door-clamp member of the hinge assembly of FIG. 1.
Figure 4B:
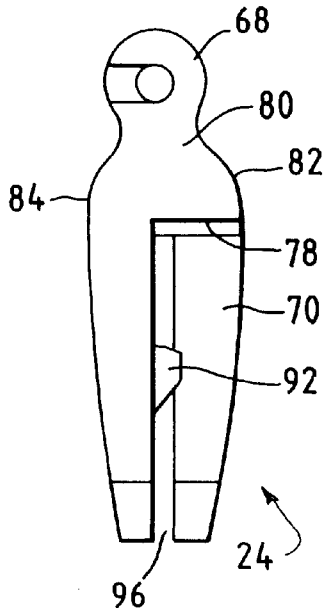
FIG. 4B is a side view of the door-clamp member of the hinge assembly of FIG. 1.

Referring now to FIGS. 4A and 4B, there is shown a door-clamp member 24 that includes a body portion 66, at least one and preferably two hinge posts 68, a tongue support 70 and at least one and preferably two locking tabs 72. The door-clamping member 24 connects the door panel 12 to the hinge assembly 14, enabling the panel 12 to be pivoted into an open or closed position relative to the storage rack 10.

The body portion 66 has a first end 74, a second end 76, a front portion 78, a rear portion 80, and first and second edges 82, 84. Notably, it is contemplated that the body portion 66 of the door-clamping member 24 can have various configurations without departing from the novel scope of the present invention.

The locking tabs 72 are integrally formed with the body portion 66. Preferably the locking tabs 72 are positioned adjacent to the first edge 82, extending in an outward, generally transverse direction relative to the front portion 78. It is preferable that at least one locking tab 72 is positioned at each of the respective first and second ends 74, 76 in order to provide a secure mounting connection with the panel 12.

The locking tab 72 has an opening 86 defined therein, and a biased finger 88. The biased finger 88 extends from a peripheral portion 90 of the tab 72, to flex generally into the opening 86 from a peripheral portion 90 of the tab 72, to flex generally transversely to the tab opening 86. The biased finger 88 has a hub or detent portion 92 that extends generally transversely from the finger 88. Preferably, the biased finger 88 is formed of a relatively resilient material to permit the finger 88 to flex.

The tongue support 70 is integrally formed with the body portion 66 and is positioned in a spaced, generally parallel relationship to the locking tabs 72, adjacent to the second edge 84 of the body portion 66. The tongue 70 extends in an outward, generally transverse direction from the front portion 78 parallel to and between the tabs 72. The tongue 70 has a panel 12 engaging or bearing surface 94.

To connect the panel 12 to the door clamp member 24, the panel 12 is positioned between the tongue support 70 and locking tabs 72 and is urged into the space (indicated at 96 in FIG. 4B) between the tongue 70 and tabs 72. Those skilled in the art will recognize that the holes 98 in the panel 12 must be space to align with the finger detents 92 of the door clamp member 24 so as to properly lock the panel 12 to the member 24. In this manner, the locking tabs 72 engage the panel first surface 100, providing a biasing force against the first surface 100, and the tongue support 70 engages the second surface 102, to secure the panel 12 in the member 24. That is, the panel 10 is sandwiched between the tongue 70 and tabs 72. When the panel 12 is fully engaged with the door-clamp member 24, the fingers 88 tend to return to their "at rest" state, which urges the detents 92 into the holes 98 in the panel 12, thus locking the panel 12 to the member 24.

The hinge post 68 is also integrally formed with the body portion 66. Preferably, hinge posts 68 are positioned at respective first and second ends 74, 76 of the body portion 66. In a current embodiment, the hinge post 68 has a generally cylindrical shape. Each hinge post 68 has first and second bearing surfaces 104 and 106 and a helically curved surface 108, located intermediate the bearing surfaces 104, 106. The curved surface 108 has a generally helical shape, which extends in an angled or inclined manner from the first bearing surface 104 to the second bearing surface 106.

The post plate 22 cooperates with the door-clamp member 24 to enable the panel 12 to be pivoted into an open or closed position relative to the storage rack 10. The post plate 22 has a curved outer edge 25, which facilitates pivoting movement with the door clamp member 24. In a fully open position, the door clamp member second bearing surface 106 rests on the post plate first bearing surface 60. In a fully closed position, the door clamp member first bearing surface 104 rests on the post plate second bearing surface 62. During pivoting i.e., between the open and closed positions, helical surface 64 transverses (e.g., slides) along surface 108 to urge or move the panel 12 to the closed position.

To move the panel 12 from the open position to the closed position, the panel 12 is pivoted such that surface 108 rides up along surface 64 until bearing surface 106 rests on bearing surface 60. Because these surfaces are "flat" the panel will remain in the open position. However, the slightest urging of the panel 12 toward the closed position moves these "flat" surfaces 106 and 60 out of engagement, positions the helical surfaces 64, 108 in engagement and the panel 12 will thus pivot to the closed position. In this arrangement, the curved surface 108 of the hinge post 68 engages the curved surface 66 of the post plate 22 in a generally complementary manner, enabling the curved surfaces 66 and 108 to slide relative to each other. The pivotal sliding movement causes the hinge assembly 14 and associated door panel 12 to rotate, thereby moving the panel 12 and hinge assembly 14 into a closed position.

In a preferred embodiment, the post plate 22 and door-clamping member 24 each have a generally symmetrical configuration, which enables the assembly 14 to be reversibly mounted to either the left post 16 or the right post, as desired. When positioned on the left post, the connected door panel 12 extends from the left post of the rack 10 into a space in front of the shelf and opens in a generally clockwise manner (as viewed from the top) away from the shelf, exposing the contents on the rack. For reversed positioning on the right post, the post plate 22 slides along the pin 54 from one end of the door-clamping member 24 to the other. When positioned on the right post 16, the connected door panel 12 extends from the right side of the rack 10 into a space in front of the shelf and opens in a generally counterclockwise manner relative to the left post 16. Those skilled in the art will recognize that it is only the upper hinge post 68 and hinge portion upper end 36 that are used for pivoting/closing the panel 12 that the lower hinge post 68 is used only to provide a secure mounting for the hinge pin 54. It is only when the hinge assembly 14 is reversed (i.e., used on the opposite door) that the hinge posts 68 and hinge portion "upper" and "lower" ends 50, 52 are reversed and thus used. Those skilled in the art will therefore appreciate that the hinge assembly 14 can be fabricated as a "left-only" or "right-only" member and thus require only one "set" of bearing and helical bearing surfaces on the door clamping member and door post hinge portion.

Those skilled in the art will recognize that although the present hinge assembly 14 is described as being mounted to a vertical post 16, the assembly 14 can readily be adapted for mounting to a horizontal member, such as a shelf, using an arrangement such as that illustrated in Conway et al., U.S. Pat. No. 6,108,956, (which patent is commonly assigned with the resent application and is incorporated herein by reference), and can be mounted for pivoting in a horizontal plane as well as a vertical plane. All such mountings and adaptations are within the scope and spirit of the present invention.

All patents referred to herein, are hereby incorporated herein by reference, whether or not specifically do so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims when the claims are properly interpreted.

What is claimed is:

1. A hinge mounting assembly for mounting an associated door panel to a storage rack, the rack including at least one mounting region having a first face and a second face, the first face having slots therein, the door panel having at least one bore defined therein, the hinge mounting assembly comprising:

a mounting plate mountable to the mounting region, the mounting plate including a base portion for positioning adjacent the first face of the mounting region, a return for positioning adjacent the second face of the mounting region, and a body, the base portion having at least one mounting lock extending generally outwardly therefrom and configured to be inserted into the first face slots, the mounting lock having a lip portion for securely locking the mounting plate to the first face slot, the body having a hinge portion having a first end and a second end, the first end having first and second plate bearing surfaces and an intermediate helically extending surface between the first and second plate bearing surfaces;

a door clamping member pivotally mounted to the mounting plate, the door clamping member having a body, a hinge post, a tongue support and at least one locking tab, the locking tab extending in a generally transverse direction from the body for engagement with a first surface of the panel, the locking tab including an opening and a finger extending into the opening configured for insertion into the bore in the panel, the tongue support extending generally outwardly from the body for providing an abutting surface with a second surface of the panel, the tongue support and locking tab cooperating with one another to provide secure mounting of the door panel, the hinge post having first and second clamp bearing surfaces and a helically extending clamp bearing surface between the first and second clamp bearing surfaces; and a hinge pin pivotally connecting the mounting plate and the door clamping member, wherein when the hinge mounting assembly is in an open position, the second clamp bearing surface bears on the first plate bearing surface, when in a closed position the second clamp bearing surface bears on the second plate bearing surface, and when in an intermediate position between the open and closed position, the plate helical surface and clamp helical surface slide relative to each other such that the hinge assembly tends to move to the closed position.

2. The hinge mounting assembly in accordance with claim 1 wherein the mounting plate base portion has two mounting locks for insertion into respective first face slots.

3. The hinge mounting assembly in accordance with claim 1 wherein the finger includes a detent portion for insertion into the bore in the panel.

4. The hinge mounting assembly in accordance with claim 1 wherein the mounting plate body has a curved outer edge.

5. The hinge mounting assembly in accordance with claim 1 wherein the base portion of the mounting plate includes at least one bore for receiving a fastening member.

6. The hinge mounting assembly in accordance with claim 1 wherein the door clamping member has two locking tabs for engagement with the first surface of the panel.

7. The hinge mounting assembly in accordance with claim 6 wherein the tongue support is disposed between the looking tabs.

8. The hinge mounting assembly in accordance with claim 1 wherein the second end of the mounting plate body includes first and second mounting plate bearing surfaces and an intermediate helically extending surface between the first and second mounting plate bearing surfaces.

9. The hinge mounting assembly in accordance with claim 8 wherein the door clamping member has two hinge posts positioned at respective opposing ends of the door clamping member for engagement with respective first and second ends of the mounting plate body.

10. A hinge mounting assembly for mounting an associated door panel to a storage rack, the rack including at least one post having slots therein, the door panel having at least one bore defined therein, the hinge mounting assembly comprising:

a post plate mountable to the post, the post plate including a base portion, a post return, and a body, the base portion having at least one post lock configured to be inserted into the post slots for securely locking the post plate to the post, the body having a hinge portion having a first end having first and second post bearing surfaces, and an intermediate helical surface between the first and second surfaces, a door clamping member pivotally mounted to the post plate, the door clamping member having a hinge post and at least one locking tab for engagement with the panel, the hinge post having first and second door clamp bearing surfaces and an intermediate helical surface between the first and second surfaces, for engagement with the post bearing surfaces; and a hinge pin pivotally connecting the post plate and the door clamping member, wherein when the hinge mounting assembly is in an open position, the second clamp bearing surface bears on the first post bearing surface, when in a closed position the second clamp bearing surface bears on the second post bearing surface, and when in an intermediate position between the open and closed position, the post helical surface and clamp helical surface slide relative to each other such that the hinge assembly tends to move to the closed position.

11. The hinge mounting assembly in accordance with claim 10 wherein the base portion has two post locks for insertion into respective post slots.

12. The hinge mounting assembly in accordance with claim 10 wherein the door clamping member has two locking tabs for engagement with the first surface of the panel.

13. The hinge mounting assembly in accordance with claim 10 wherein the post plate body has a curved outer edge.

14. The hinge mounting assembly in accordance with claim 10 wherein the base portion of the post plate includes at least one bore for receiving a fastening member.

15. The hinge mounting assembly in accordance with claim 10 wherein the second end of the post plate body includes first and second post bearing surfaces and an intermediate helically extending surface between the first and second post bearing surfaces.

16. The hinge mounting assembly in accordance with claim 15 wherein the door clamping member has two hinge posts positioned at respective opposing ends of the door clamping member for engagement with respective first and second ends of the post plate body.

17. The hinge mounting assembly in accordance with claim 15 wherein a tongue support is disposed between the locking tabs.

18. A hinge mounting assembly for an associated door panel for mounting to a storage rack, the rack including at least one post having a front face and a side face, the front face having slots therein, the door panel having at least one bore defined therein, the hinge mounting assembly comprising:

a post plate including means for connecting the post plate to the post and also including a helical surface, a door clamping member pivotally mounted to the post plate, the door clamping member having a body, a hinge post, and means for mounting the door panel to the door clamping member, the hinge post having first clamp and second clamp bearing surface and a helically extending clamp bearing surface between the first and second clamp bearing surfaces, and when in an intermediate position, the helical surface and the helically extending clamp bearing surface slide relative to each other such that the hinge assembly tends to move to the closed position; and means for pivotally connecting the post plate and the door clamping member.

* * * * *